US010253461B2

(12) United States Patent
Engels et al.

(10) Patent No.: US 10,253,461 B2
(45) Date of Patent: Apr. 9, 2019

(54) VARIABLE WIDTH AUTOMATIC TRANSITION

(71) Applicant: Wirtgen GmbH, Windhagen (DE)

(72) Inventors: Michael Engels, Obererbach (DE); Martin Lenz, Grossmaischeid (DE); Cyrus Barimani, Königswinter (DE)

(73) Assignee: Wirtgen GmbH (DE)

( * ) Notice: Subject to any disclaimer, the term of this patent is extended or adjusted under 35 U.S.C. 154(b) by 0 days.

(21) Appl. No.: 15/371,319

(22) Filed: Dec. 7, 2016

(65) Prior Publication Data

US 2018/0155883 A1 Jun. 7, 2018

(51) Int. Cl.
*E01C 19/42* (2006.01)
*E01C 19/48* (2006.01)

(52) U.S. Cl.
CPC ..... *E01C 19/4893* (2013.01); *E01C 19/42* (2013.01); *E01C 2301/18* (2013.01)

(58) Field of Classification Search
CPC ... E01C 19/4893; E01C 19/42; E01C 2301/18
USPC ..... 404/72, 84.05–84.2, 105, 118
See application file for complete search history.

(56) References Cited

U.S. PATENT DOCUMENTS 3,970,405 A 7/1976 Swisher
4,029,165 A * 6/1977 Miller ..... B62D 11/20 180/6.48
4,900,186 A 2/1990 Swisher
5,615,972 A 4/1997 Guntert et al.
5,695,298 A * 12/1997 Sandstrom ..... E01C 19/286 404/117
5,941,658 A 8/1999 Dahlinger et al.
6,082,927 A 7/2000 Dahlinger et al.
6,457,779 B1 10/2002 Busley et al.
6,471,442 B1 10/2002 Deeb et al.
6,582,152 B2 6/2003 Leone
6,954,999 B1 10/2005 Richardson et al.
8,571,794 B2 10/2013 Roberts et al.
(Continued)

FOREIGN PATENT DOCUMENTS

DE 19814052 A1 10/1999
DE 29918747 U1 2/2000
(Continued)

OTHER PUBLICATIONS

Leica Geosystems Machine Control Solutions brochure, Leica Geosystems AG, Heerbrugg, Switzerland, 19 pp. (undated but admitted to be prior art).
(Continued)

*Primary Examiner* — Raymond W Addie
(74) *Attorney, Agent, or Firm* — Lucian Wayne Beavers; Patterson Intellectual Property Law, PC

(57) ABSTRACT

A system for automatically varying the mold width and thus the paving width of a molded concrete slab on the fly as the slab is being molded. An external stringline reference is used to control the height and direction of a first side of the paving machine. A slope sensor is used for automatic control of the height of the second side of the machine frame. A starting point signal generator provides a signal to initiate the automatic width transition. A controller controls width actuators for controlled variation of the mold width in response to the starting signal and a pre-programmed function of the controller.

17 Claims, 7 Drawing Sheets

(56) References Cited

U.S. PATENT DOCUMENTS

| | | | | |
|---|---|---|---|---|
| 8,788,154 | B2 | 7/2014 | O'Connor et al. | |
| 8,967,908 | B1 | 3/2015 | Thieme et al. | |
| 9,121,141 | B2 | 9/2015 | Thieme et al. | |
| 9,388,537 | B2 | 7/2016 | Dahm | |
| 9,388,538 | B2 | 7/2016 | Dahm | |
| 9,388,539 | B2 | 7/2016 | Dahm | |
| 2006/0198700 | A1 | 9/2006 | Maier et al. | |
| 2008/0038059 | A1* | 2/2008 | Frelich | E01C 19/48 404/75 |
| 2014/0074295 | A1 | 3/2014 | Kumagai et al. | |
| 2016/0060820 | A1* | 3/2016 | Berning | E01C 19/004 404/75 |
| 2016/0177517 | A1 | 6/2016 | Engels et al. | |
| 2016/0177519 | A1 | 6/2016 | Fritz et al. | |
| 2018/0030672 | A1* | 2/2018 | Marsolek | E01C 19/008 |

FOREIGN PATENT DOCUMENTS

| | | | |
|---|---|---|---|
| DE | 112005003046 | B4 | 2/2014 |
| EP | 1118713 | A1 | 7/2001 |
| EP | 2006448 | A1 | 12/2008 |
| EP | 2708968 | A2 | 3/2014 |
| EP | 2708969 | A2 | 3/2014 |
| WO | 2006092441 | A1 | 9/2006 |

OTHER PUBLICATIONS

"V2 Paving Mold" by Gomaco (brochure—4 pages) (2008).
"Commander III" by Gomaco (brochure—28 pages) (2013).
European Search Report of corresponding European Patent Application No. EP 17 20 5759 dated Mar. 13, 2018, 9 pages (not prior art).

* cited by examiner

VARIABLE WIDTH AUTOMATIC TRANSITION

BACKGROUND OF THE INVENTION

1. Field of the Invention

The present invention relates generally to control systems for slipform paving machines and more particularly, but not by way of limitation, to a system for controlling changes in paving width as the machine moves forward during a paving operation.

2. Description of the Prior Art

In construction machines for forming structures on a ground surface, such as a concrete slipform paving machine, important factors include the control of the height of the working implements and thus the grade or height of the concrete structure being molded, and the control of the steering direction of the machine.

Such slipform paving machines typically take a reference reading from a stringline which has been placed on one or both sides of the intended path of the machine. In the past, when it has been desired to create a molded concrete structure having a transition from one structure width to a second structure width, two stringlines have been laid out on either side of the desired path of the machine, and the change in width of the concrete structure is created by varying the width between the two stringlines.

Another previously used technique is to have a single stringline on one side of the slipform paving machine, and to manually telescope the machine to control changes in width on the second side of the machine. In this case the height on the second side might be controlled by a slope sensor.

There is a continuing need for improved systems to allow for transition in paving width during a slipform paving operation.

SUMMARY OF THE INVENTION

In one embodiment a slipform paving apparatus includes a machine frame having a variable frame width between a first side and a second side of the machine frame. A plurality of ground engaging units are provided, with at least one of the ground engaging units being steerable to control a direction of the slipform paving machine. A plurality of height adjustable supports support the machine frame from the plurality of ground engaging units. A mold is supported from the machine frame. The mold is configured to mold concrete into a concrete structure having an upper surface and lateral concrete sides as the slipform paving machine apparatus moves forward in an operating direction. The mold is variable in mold width so as to vary a paving width of the concrete structure. At least one stringline sensor is configured to detect an external stringline reference and to generate a guidance signal for the direction and height of the first side of the machine frame. A width actuator is configured to extend and contract thus varying an extension distance of the width actuator and thereby varying the mold width. An extension sensor is configured to generate an extension signal corresponding to the extension distance of the width actuator. A starting signal generator is configured to generate a starting signal for a change in paving width. A cross slope sensor is configured to generate a cross slope signal corresponding to a cross slope of the machine frame.

A controller is provided for automatic control of a change in paving width as the paving machine moves forward in the operating direction. The controller is configured to receive the guidance signal and to control the direction and height of the first side of the machine frame in response to the guidance signal. The controller is further configured to receive the cross slope signal and to control the cross slope of the machine frame and thereby control a height of the second side of the machine frame in response to the cross slope signal. The controller is further configured to receive the starting signal and the extension signal and to control extension of the width actuator to change the paving width in response to the starting signal as the slipform paving machine apparatus moves forward in the operating direction after receiving the starting signal.

In another embodiment a method is provided for operating a slipform paving machine. The method includes the steps of:

(a) providing a slipform paving machine including:

a machine frame having a variable frame width between a first side and a second side of the machine frame;

a plurality of ground engaging units, at least one of the ground engaging units being steerable to control a direction of the slipform paving machine;

a plurality of height adjustable supports supporting the machine frame from the plurality of ground engaging units;

a mold supported from the machine frame, the mold being variable in mold width; and a width actuator configured to vary the mold width;

(b) moving the slipform paving machine forward in an operating direction and molding concrete into a concrete slab structure extending between the ground engaging units and behind the mold, the structure having an upper surface and lateral concrete sides and having a paving width;

(c) during step (b) detecting an external stringline reference with a stringline sensor of the slipform paving machine and generating a guidance signal for the direction and height of the first side of the machine frame;

(d) controlling the direction and height of the first side of the machine frame with an automatic control system in response to the guidance signal from the stringline sensor;

(e) during step (b) generating a cross slope signal with a cross slope sensor, the cross slope signal corresponding to a cross slope of the machine frame;

(f) controlling the height of the second side of the machine frame with the automatic control system in response to the cross slope signal;

(g) generating a starting signal for a change in paving width; and (h) in response to the starting signal, controlling extension of the width actuator with the automatic control system to change the mold width and thereby change the paving width in response to the starting signal as the slipform paving machine moves forward in the operating direction.

In any of the above embodiments the controller may be configured to control extension of the width actuator in accordance with a pre-programmed function.

In any of the above embodiments the apparatus may further include a travel distance sensor configured to generate a travel distance signal representative of a distance traveled by the slipform paving machine apparatus in the operating direction beyond an initial location of the slipform paving machine apparatus at a time of receipt of the starting signal. The controller is further configured to control the extension of the width actuator in accordance with the pre-programmed function as a function of the travel distance.

In any of the above embodiments the travel distance sensor may include a rotary pickup sensor associated with at least one of the ground engaging units.

In any of the above embodiments the pre-programmed function may be of the form Y=tan h(X), where Y is the paving width and X is the travel distance.

In any of the above embodiments the pre-programmed function may be of the form that Y is a linear function of X.

In any of the above embodiments the machine frame and the mold may be connected such that the mold width varies when the machine frame width varies, and the width actuator is arranged to vary the frame width and thereby vary the mold width and the paving width.

In any of the above embodiments the mold may be variable in mold width independently of the frame width over at least a portion of a variable mold width range.

In any of the above embodiments the starting signal generator may include a starting point sensor configured to detect the presence of a starting point indicating structure fixed relative to the external stringline reference.

In any of the above embodiments the starting point sensor may be configured to engage the starting point indicating structure.

In any of the above embodiments the starting point sensor may be configured to detect the proximity of the starting point indicating structure without contacting the starting point indicating structure.

In any of the above embodiments the starting signal generator may include a manual start input configured such that a human operator of the paving machine apparatus can initiate the starting signal by manual operation of the manual start input.

In any of the above embodiments the starting signal generator may include a starting signal receiver configured to receive an external starting signal from a remote source.

In any of the above embodiments the starting signal generator may include a stringless reference object configured to detect the position of the stringless reference object in a three dimensional reference system.

In any of the above embodiments the width actuator may include a piston and cylinder arrangement, and the extension sensor may be integrated in the piston and cylinder arrangement.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

In FIG. 6 the mold width is in an extended maximum width position.

DETAILED DESCRIPTION

Figure 1:
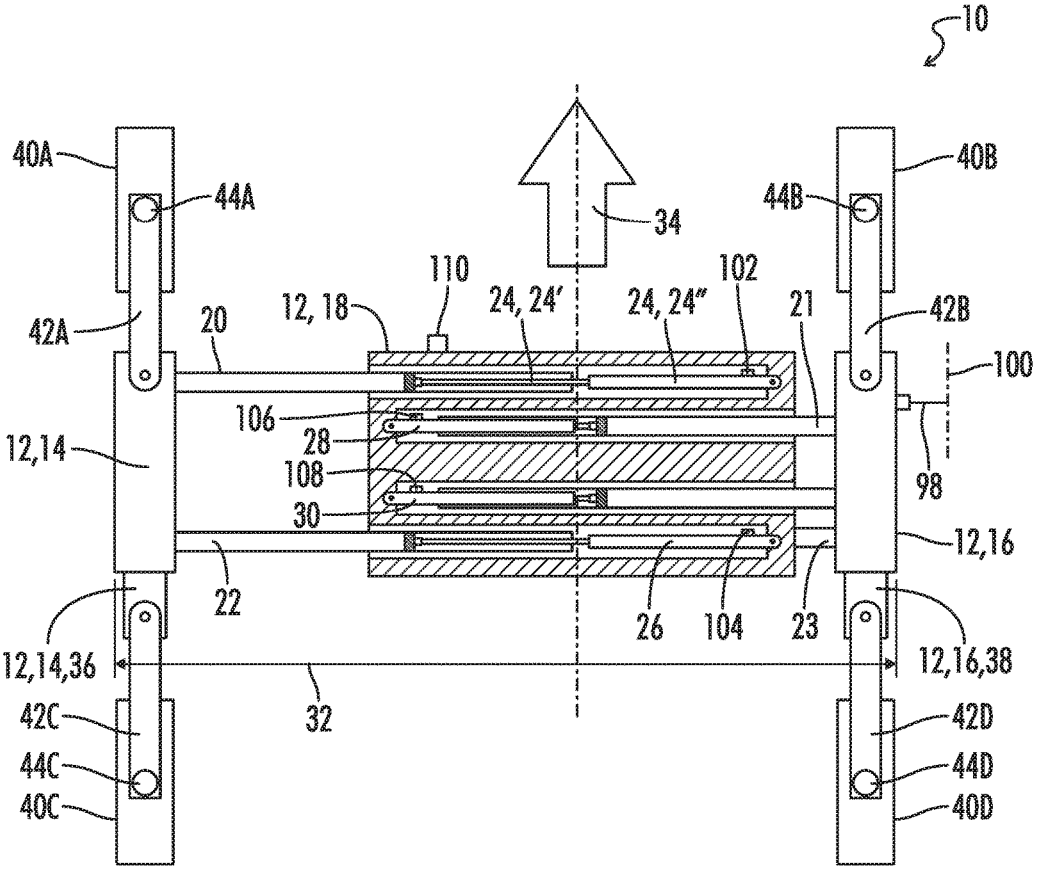
FIG. 1 is a schematic plan view of a first embodiment of a slipform paving machine having a main frame module and having left and right side frame members both laterally extendable relative to the main frame module. The side frame members are also longitudinally extendable to extend the length of the slipform paving machine.

FIG. 1 schematically illustrates a slipform paving machine apparatus 10 including a machine frame 12. The machine frame 12 includes right and left side frame members 16 and 14 which are laterally extendable relative to a main frame module 18. The right and left side frame members 16 and 14 may also be referred to as first and second side frame members 16 and 14. The frame 12 may also be constructed to be extendible on only one side.

The left side frame member 14 is attached to forward and rear male telescoping members 20 and 22 which are received within the main frame module 18 in a telescoping manner. Forward and rear left side actuating rams 24 and 26 are connected between the main frame module 18 and the left side frame member 14 to control lateral extension and retraction of the left side frame member 14 relative to the main frame module 18.

Forward and rearward male telescoping members 21 and 23 are similarly attached to the right side frame member 16 and are telescopingly received in the main frame module 18. Forward and rear right side actuating rams 28 and 30 are connected between the main frame module 18 and the right side frame member 16 to control lateral extension and retraction of the right side frame member 16 relative to the main frame module 18.

The rams 24, 26, 28 and 30 may all be referred to as width actuators or linear actuators configured to vary a distance between the side frame members 14 and 16 and to thereby vary a frame width 32. Each of the linear actuators is configured to extend and contract to vary an extension distance of the linear actuator and to thereby vary the frame width 32. Each of the rams such as 24 includes a piston 24' and a cylinder 24" configured to expand and contract the frame width 32. It will be understood that the width actuators do not have to be hydraulic rams. Electric linear actuators, rotary driven linear actuators, and any other suitable actuators may be used.

The side frame members 14 and 16 are also constructed so as to be adjustable in length parallel to a paving direction or operating direction indicated by the arrow 34. Thus the left side frame member 14 includes a rearwardly extendable left side frame portion 36 and the right side frame member 16 includes a rearwardly extendable right side frame portion 38.

The paving machine 10 includes four ground engaging units 40A, 40B, 40C and 40D which in the illustrated embodiment are crawler tracks. Wheels could also be used as ground engaging units. The machine frame 12 further includes four frame swing arms 42A, 42B, 42C and 42D which are pivotally attached to the machine frame 12 and which carry the ground engaging units 40A-40D at their outer ends. Also instead of the unitary swing arms 42 as shown, parallelogram style swing arms such as seen in U.S. Pat. No. 6,471,442 could be used.

Associated with each of the ground engaging units 40A-40D are height adjustable supports or lifting columns 44A, 44B, 44C and 44D. In the embodiment of FIG. 1, front and rear left side height adjustable supports 44A and 44C, respectively, support the left side frame member 14 from the ground engaging units 40A and 40C, respectively. Front and rear right side height adjustable supports 44B and 44D support the right side frame member 16 from the ground engaging units 40B and 40D, respectively.

Figure 2:
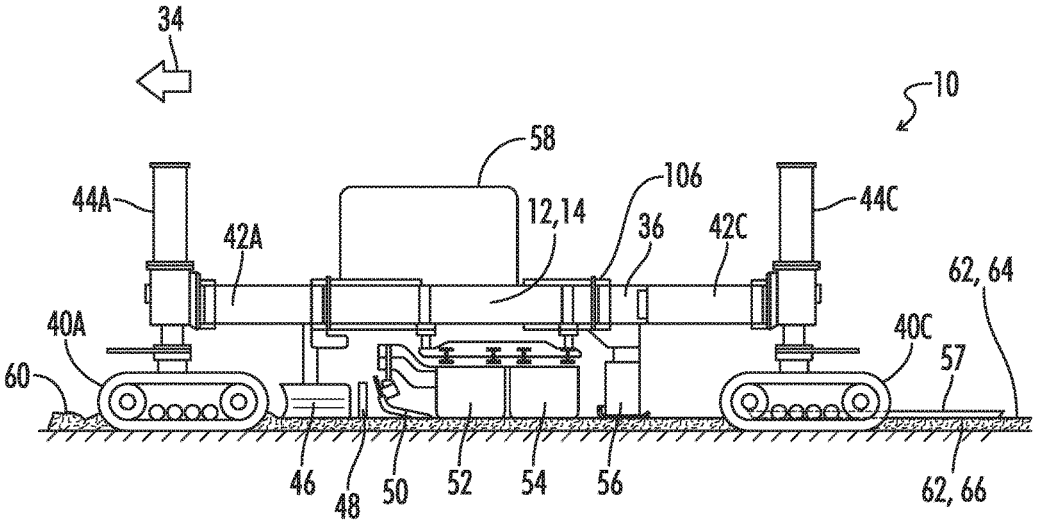
FIG. 2 is a left side elevation view of the slipform paving machine of FIG. 1.
Figure 3:
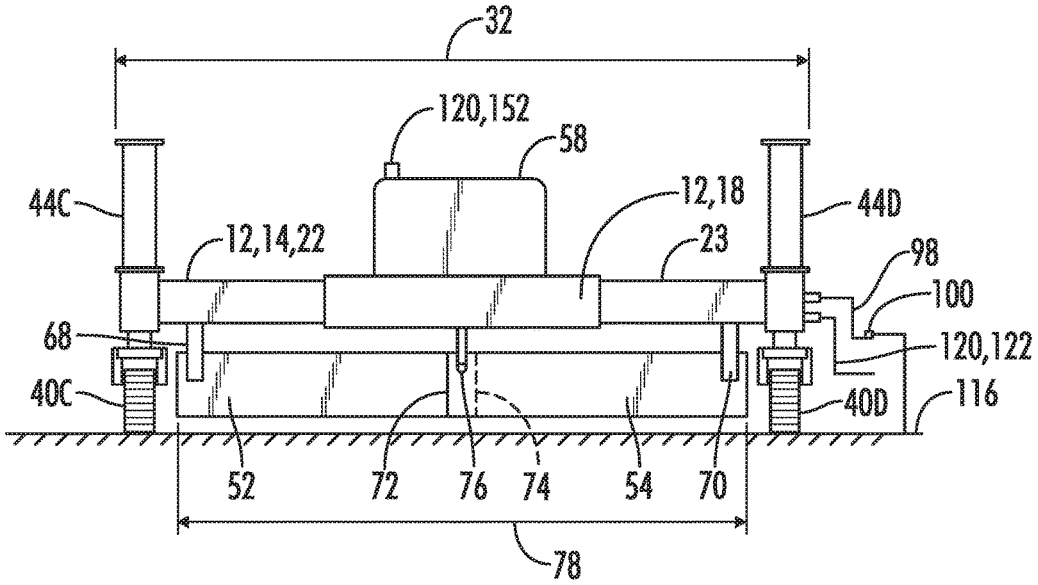
FIG. 3 is a rear elevation view of the slipform paving machine of FIGS. 1 and 2, showing the machine frame and the mold in a first position with the machine frame and the mold extended to a maximum width.

Further features of the slipform paving machine 10 are seen in FIGS. 2 and 3. As seen in FIG. 2, a number of tools are carried by the machine frame 12, including a plow or concrete spreader 46, a front wall 48, a system of vibrators or concrete liquefying devices 50, first and second mold portions 52 and 54, an oscillating beam 56 and a super smoother 57. Other components such as a dowel bar inserter (not shown) may also be supported from the slipform paving machine.

Also carried on the machine frame 12 is a tractor operations module 58 which may include a diesel engine for powering the various hydraulic and electrical systems, a control platform, an operator station and the like.

As is seen in FIG. 2, a mass of concrete 60 is placed in front of the slipform paving machine 10 and then the various components just described, and particularly the mold 52, 54, forms the concrete 60 into a molded concrete structure 62 having an upper surface 64 and having formed sides such as 66.

The mold 52, 54 may be described as a variable width mold supported from the machine frame 12 beneath the machine frame 12 and laterally between the ground engaging units 40A and 40C on the left side and the ground engaging units 40B and 40D on the right side. The mold 52, 54 is configured to mold the concrete 60 into the concrete structure 62 having an upper surface 64 and lateral concrete sides such as 66 as the machine 10 moves forward in the operating direction 34. The forward and rearward mold portions 52 and 54 are attached to the machine frame 12 adjacent their laterally outer end portions by attachments such as 68 and 70. The inner ends 72 and 74 of mold portions 52 and 54 are slidably supported from a central vertical support 76 relative to frame 12. The central support 76 may be vertically adjusted to create a crown in the molded structure 62. The laterally inner end portions 72 and 74 overlap so that they may slide relative to each other as the frame width 32 of machine frame 12 is varied. Thus in the embodiment shown in FIGS. 1-3, variations in the frame width 32 result in variations in a mold width 78.

Figure 4:
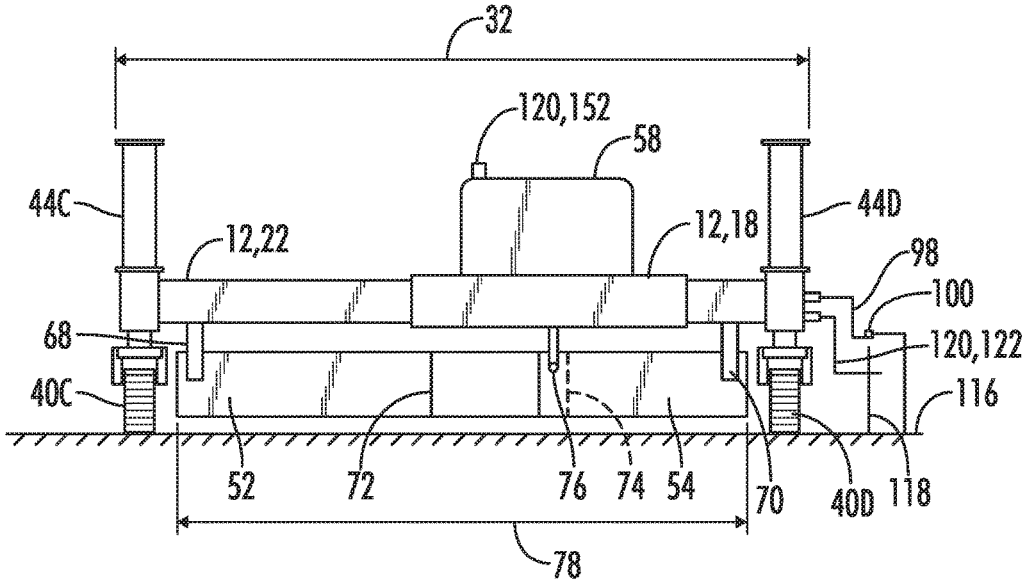
FIG. 4 is view similar to FIG. 3, showing both the machine frame and the mold contracted to a smaller frame width and mold width simultaneously.

FIGS. 3 and 4 illustrate an extended and contracted position, respectively, of the machine frame 12 and the mold 52, 54. In FIG. 3, all of the width actuators 24, 26, 28 and 30 are fully extended so that the frame width 32 is at its maximum extension and the mold width is at its maximum mold width extension. In FIG. 4, the right side hydraulic cylinders 28 and 30 have been contracted, somewhat as illustrated in FIG. 1, thus shortening both the frame width 32 and the mold width 78. The mold width can be adjusted to any width within a mold width range that can be achieved by the extension and retraction of the various width actuators 24, 26, 28 and 30.

It will also be understood that the mold can be supported independently from the machine frame in such a manner that to a limited extent the mold width can be adjusted independently from the frame width. Such an embodiment is further described below with regard to FIGS. 6-7. In either situation, a change in mold width will correspond to a change in paving width Y (see FIG. 9) of the concrete structure being formed.

Figure 5:
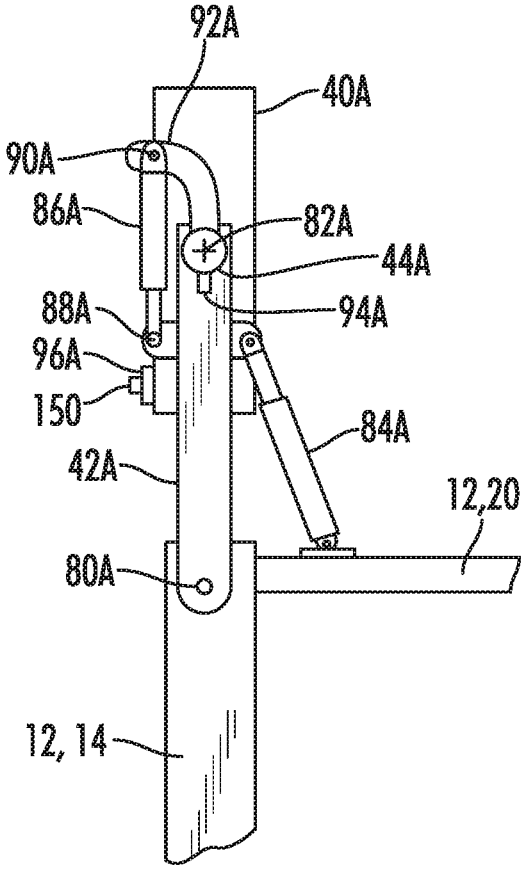
FIG. 5 is a schematic plan view of the details of the steering system and swing leg control system hardware associated with the left front swing leg and crawler track of the machine of FIG. 1.

As is best seen in FIG. 5, which is a schematic plan view of the crawler track and swing leg supporting the left front corner of the machine frame 12, each of the swing legs such as 42A is pivotally connected to the machine frame 12 at a pivot axis such as 80A. The crawler track or ground engaging unit 40A is steerably connected to the free end of the swing leg 42A and may be steered about a vertical axis 82A of the height adjustable lifting column 44A. A holding device 84A such as a hydraulic ram or turn buckle maintains the pivotal orientation of the swing leg 42A relative to the machine frame 12.

In the drawings, the swing legs 42 and holding devices 84 are schematically illustrated as being directly connected to the machine frame 12. It will be understood, however, that the swing legs and holding devices do not have to be directly connected to the machine frame 12. Instead, the swing legs and holding devices may be indirectly connected to the machine frame 12 by suitable mounting brackets. When one of these components is described herein as being connected to the machine frame 12, that includes both direct and indirect connections.

Steering of the crawler track 40A relative to the frame 12 about the vertical axis 82A is accomplished by extension and retraction of a hydraulic steering cylinder 86A pivotally connected at 88A to an intermediate location on the swing leg 42A and pivotally connected at 90A to a steering arm 92A connected to rotate with the ground engaging unit or crawler track 40A. Alternatively, instead of the use of a hydraulic ram steering cylinder 86A, the track 40A may be steered relative to the frame 12 by a rotary actuator such as a worm gear or slew gear drive. Also, an electric actuator may be used instead of a hydraulic actuator to steer the crawler track. Each of the crawler tracks such as 40A may have a steering sensor such as 94A associated therewith, which steering sensors are configured to detect the steering angles of their respective crawler tracks relative to their respective swing legs such as 42A. The steering sensors may for example each be an electromagnetic encoder commercially available from TWK-Elektronik GmbH, Heinrichstrasse 85, 40239 Düsseldorf, Germany, as Model TMA 50-SA180WSA16.

Each of the ground engaging units such as 40A may be a powered or driven ground engaging unit and may be powered such as by a hydraulic drive motor 96A.

Figure 10:
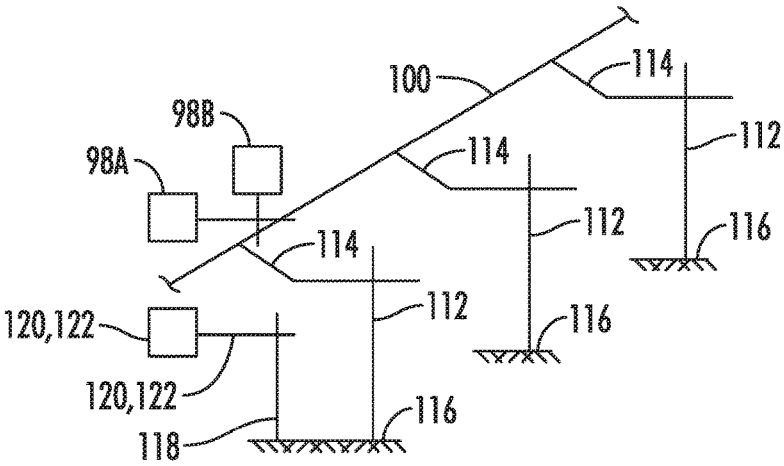
FIG. 10 is a schematic perspective view of the external stringline reference, the starting point indicating structure, and the various sensors on the paving machine which interact with the external stringline reference and the starting point indicating structure.

Although the embodiment shown in FIG. 1 illustrates a four track slipform paving machine, it will be understood that the principles set forth herein may also be utilized on two track or three track machines The right hand side or first side 16 of machine frame 12 has a stringline sensor 98 mounted thereon to detect an external stringline reference 100 and to generate a guidance signal for the direction and height of the right side 16 of machine frame 12. It will be understood that the string line sensor 98 will typically include four sensor mechanisms, one each for the height and the steering direction at the front and at the rear of the right side 16 of machine frame 12. FIG. 10 schematically illustrates one height stringline sensor 98A and one steering stringline sensor 98B.

FIG. 10 shows a schematic perspective illustration of the external stringline reference 100. As will be understood by those skilled in the art, the external stringline reference 100 may be constructed with a generally horizontal stringline supported from a plurality of vertical stakes 112 each carrying a horizontal support arm 114, with the stringline 100 being supported from the support arms 114. The vertical stakes 112 may be driven into the ground surface 116. As is also schematically illustrated in FIG. 10 the stringline sensor 98 may be made up of a height sensor component 98A and a steering sensor component 98B, each of which engage the stringline 100 as shown.

The present system for the automatic control of a variable width transition for a paving slab may utilize a starting point indicator 118, which in the embodiment shown in FIG. 10 is another vertical stake 118 driven into the ground 116 in a fixed position relative to the external stringline reference 100.

A starting signal generator 120 may include a starting point sensor configured to engage the starting point indicating structure 118 when the mold 52, 54 reaches a location where it is desired to change the width of the molded concrete structure 62.

Figure 9:
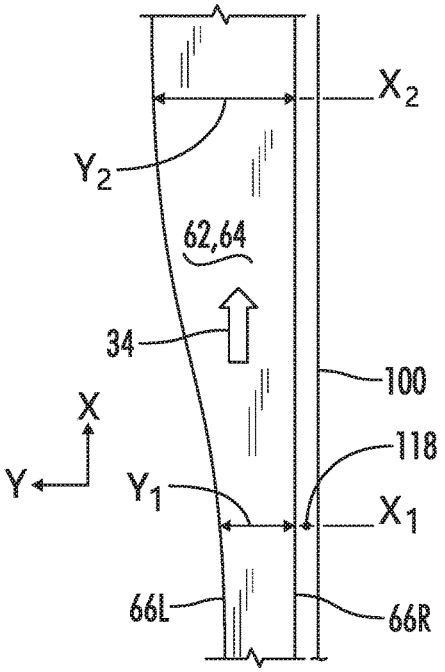
FIG. 9 is a schematic plan view of a concrete slab structure having a width transition such as may be formed by the slipform paving apparatus disclosed herein.

For example, FIG. 9 shows a schematic plan view of a molded concrete structure 62 having a left edge 66L and a right edge 66R. The structure 62 was paved by the paving machine 10 moving in the direction 34. The external stringline reference 100 is shown to the right of the concrete structure 62. X and Y dimensions are indicated in FIG. 9, with the X dimension representing the position along the length of the concrete structure 62, and with the Y dimension representing the paving width. In the example illustrated in FIG. 9, it will be appreciated that with the paving machine 10 moving in the direction 34 to form the concrete structure 62, the paving machine was initially paving a narrower paving slab of width $Y_1$ and then while the machine was moving in the direction 34 the mold width was increased gradually from width $Y_1$ at position $X_1$ to a wider width $Y_2$ at position $X_2$.

To form the variable width paving slab 62 as shown in FIG. 9, the construction machine 10 must receive a starting signal to tell it when to begin its transition from paving width $Y_1$ to paving width $Y_2$, and to tell the machine how to vary that width as the machine continues to move in the direction 34.

Thus, the starting point indicating structure 118 can be set in the ground adjacent the external stringline reference 100 at or in the vicinity of the starting point $X_1$ so that the starting signal will be triggered when the mold 52, 54 is at the location $X_1$.

Each of the width actuators 24, 26, 28 and 30 has associated therewith an extension sensor 102, 104, 106 and 108, respectively. Each of the extension sensors generates an extension signal corresponding to an extension distance of the width actuator. In a preferred embodiment the hydraulic cylinder units 24, 26, 28 and 30 are smart cylinders which have their respective extension sensors integrally mounted therein. For example, the hydraulic cylinders may be intelligent hydraulic cylinders using magnetostrictive absolute non-contact linear position sensors such as those sold by MTS Sensors under the brand name TEMPOSONICS®.

Also, the extension sensors can be physically separate from the actuator rams. For example, separate extension sensors (not shown) can be connected between the main frame module 18 and each of the side frame members 14 and 16. Also there could be a single extension sensor extending between the side frame members 14 and 16. Furthermore, the extension sensors can be any known type of sensor, such as laser sensors, ultrasonic sensors, wire rope sensors, or the like.

The slipform paving machine 10 further includes a cross slope sensor 110 configured to generate a cross slope signal corresponding to a cross slope of the machine frame 12. As is further explained below, when the direction and height of the right side 16 of machine frame 12 are controlled in response to the string line sensor 98 engaging the external string line reference 100, the height of the left side 14 of machine frame 12 may then be controlled in response to the cross slope signal from the cross slope sensor 110. The paving machine 10 may also include the frame distortion control features utilized in connection with the cross slope sensor 110 as disclosed in U.S. Patent Application Publication No. 2016/0177519 to Fritz et al. and assigned to the assignee of the present invention, the details of which are incorporated herein by reference.

One or more of the ground engaging units such as 40A may include a travel distance sensor 150 configured to generate a travel distance signal representative of a distance traveled by the slipform paving machine 10 in the operating direction 34 beyond an initial location such as for example the position $X_1$ shown in FIG. 10. The initial location may be the location of the slipform paving machine 10 at a time of receipt of the starting signal from the starting signal sensor 122. The travel distance sensor 150 may be a rotary pickup sensor 150 associated with the ground engaging unit 40A.

Control System

Figure 8:
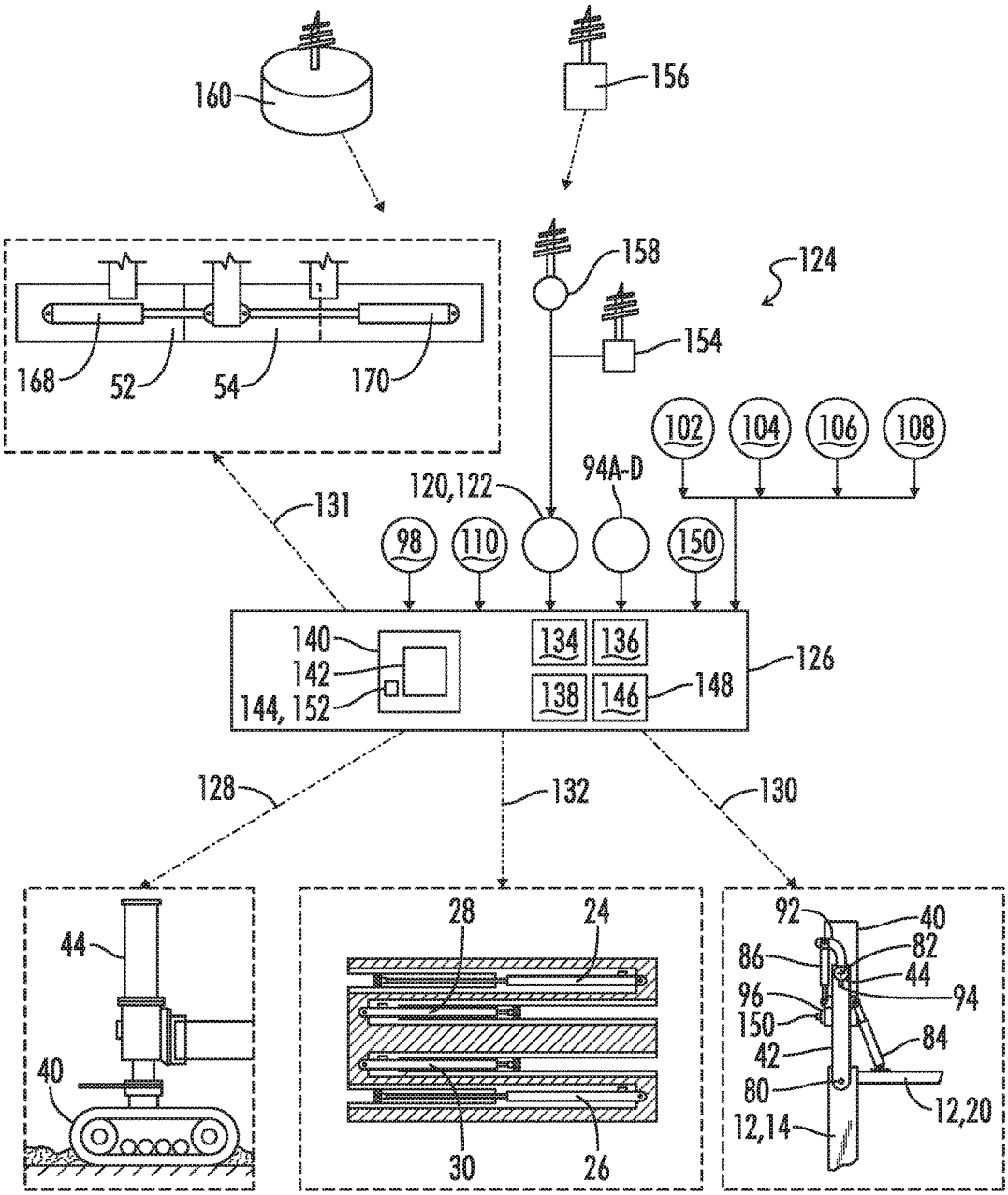
FIG. 8 is a schematic illustration of a control system associated with the slipform paving machine of either embodiment.

Referring now to FIG. 8, an automatic control system 124 for the slipform paving machine 10 is there schematically shown. The automatic control system 124 includes a controller 126. The controller 126 receives input signals from the stringline sensor 98, the cross slope sensor 110, the starting signal sensor 122, the steering sensors 94A-D, and the extension sensors 102, 104, 106 and 108. The controller 126 may also receive other signals indicative of various operational functions of the paving machine 10. Communication of height adjustment signals from the controller 126 to the height adjustable columns 44 of the machine 10 are schematically illustrated in FIG. 8 by the communication 128. It will be understood that the height adjustable columns 44 each include a hydraulic ram (not shown) actuated by a hydraulic control valve which controls flow of hydraulic fluid to and from the opposite sides of the hydraulic ram. The hydraulic control valves may be controlled by electrical signals conducted over communication line 128 from controller 126 in a known manner.

Similarly the controller 126 may control the direction of the slipform paving machine 10 by steering of the ground engaging units 40 via their respective steering cylinders 86. Communication of such steering signals from controller 126 to the various steering cylinders 86 is schematically illustrated by communication 130 shown in FIG. 8. Again, electrical steering signals may be communicated over communication line 130, to electrically actuate hydraulic control valves (not shown) which direct hydraulic fluid to and from the hydraulic rams 86 in a known manner to steer each of the ground engaging units.

The controller 126 may control the extension of the width actuators 24, 26, 28 and 30 via communication line 132 as schematically illustrated in FIG. 8 to control the hydraulic rams 24, 26, 28 and 30 so as to vary and to control the frame width 32. Controller 126 sends electrical control signals via the communication line 132 to electrically actuated hydraulic valves (not shown) associated with each of the hydraulic rams 24, 26, 28 and 30 to direct hydraulic fluid to and from the rams 24, 26, 28 and 30 to control extension and retraction of the same.

Controller 126 includes or may be associated with a processor 134, a computer readable medium 136, a data base 138 and an input/output module or control panel 140 having a display 142. An input/output device 144, such as a keyboard or other user interface, is provided so that the human operator may input instructions to the controller. It is understood that the controller 126 described herein may be a single controller having all of the described functionality, or it may include multiple controllers wherein the described functionality is distributed among the multiple controllers.

Various operations, steps or algorithms as described in connection with the controller 126 can be embodied directly in hardware, in a computer program product 146 such as a software module executed by the processor 134, or in a combination of the two. A computer program product 146 can reside in RAM memory, flash memory, ROM memory, EPROM memory, EEPROM memory, registers, hard disk, a removable disk, or any other form of computer-readable medium 136 known in the art. An exemplary computer-readable medium 136 can be coupled to the processor 134 such that the processor can read information from, and write information to, the memory/storage medium. In the alternative, the medium can be integral to the processor. The processor and the medium can reside in an application specific integrated circuit (ASIC). The ASIC can reside in a user terminal. In the alternative, the processor and the medium can reside as discrete components in a user terminal.

The term "processor" as used herein may refer to at least general-purpose or specific-purpose processing devices and/or logic as may be understood by one of skill in the art, including but not limited to a microprocessor, a microcontroller, a state machine, and the like. A processor can also be implemented as a combination of computing devices, e.g., a combination of a DSP and a microprocessor, a plurality of microprocessors, one or more microprocessors in conjunction with a DSP core, or any other such configuration.

In a preferred embodiment, the controller 126 is configured to automatically control the width transition of the slipform paving machine 10 to pave a concrete structure 62 of variable width, such as for example the concrete slab structure 62 schematically illustrated in FIG. 9. The slipform paving machine 10 equipped and configured as described above provides an economical and efficient apparatus capable of performing such automatic control. The direction and height of the right side of the paver 10 may be controlled by the controller in response to a guidance and control signal received from the stringline sensor 98. The height of the left hand or second side 14 of the slipform paving machine 10 may be controlled by the controller 126 in response to the cross slope signal received from the cross slope sensor 110. The extension of one or more of the width actuators 24, 26, 28 and 30 to change the paving width Y as the machine 10 moves ahead in the operating direction 34 is controlled by the controller 126 in response to the starting signal from starting signal sensor 122 and in response to the extension signals received from the extension sensors 102, 104, 106 and 108.

The controller 126 may be configured to control the extension of the width actuators 24, 26, 28 and 30 in accordance with a pre-programmed function 148 which may be incorporated as part of the computer program 146.

In one embodiment the pre-programmed function 148 may be such that the controller 126 is configured to control the extension of the width actuators 24, 26, 28 and 30 as a function of the travel distance.

Figure 11:
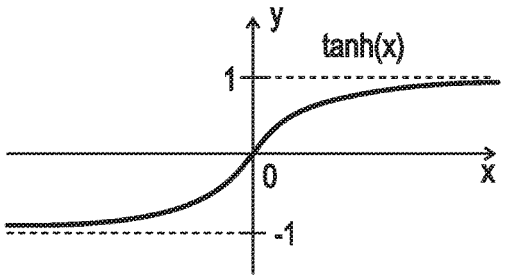
FIG. 11 is a graphical illustration of a tan h(x) function.

In another embodiment, the pre-programmed function 148 may be a function in the form Y=tan h(X), where Y is the paving width and X is the travel distance. FIG. 11 is a graphical representation of a generalized such function in the form Y=tan h(X).

In still another embodiment the pre-programmed function 148 may be of the form that Y is a linear function of X. Thus the pre-programmed function could be in the form Y=a+bX where a and b are constants. Another form of pre-programmed function could be Y(X)=square root (a*X−b). Another form of pre-programmed function could be a sectionwise defined function that changes for different defined sections of the concrete slab.

In the embodiment illustrated in FIG. 4, the starting signal generator 120 including starting signal sensor 122 is configured to detect the presence of the starting point indicating structure 118 by engagement of the starting point sensor 122 with the starting point indicating structure 118.

It will be appreciated that other types of starting point generators 120 including other types of starting point sensors 122 may be utilized. For example, the starting point sensor 122 could be a contactless sensor such as an induction sensor or optical sensor configured to detect the presence of the starting point indicating structure 118 without contacting the starting point indicating structure 118.

In another embodiment the tractor operations module 58 may include a manual start input 152 as part of the starting signal generator 120, so that a human operator of the paving machine 10 can initiate the starting signal by manual operation of the manual start input 152. The manual start input 152 may be a button or switch located on the control panel of the operations module 58. The manual start input 152 is represented in the control system drawing of FIG. 8 as part of the input output device 144.

In another embodiment, the starting signal generator 120 may include a starting signal receiver 154 configured to receive an external starting signal from a remote source 156.

In another embodiment, the starting signal generator may include a stringless reference object 158 configured to detect a position of the stringless reference object 158 in a three dimensional reference system. For example, the three dimensional reference system may be a global navigation satellite system (GNSS), such as the GPS system utilized in North America. Such GNSS systems utilize signals from a plurality of satellites schematically illustrated as 160 in FIG. 8. Another three dimensional stringless reference system would be a ground based optical surveying system such as a total station. Utilizing either such system the stringless reference object 158 attached to the slipform paving machine 10 may detect the position of the stringless reference object in the three dimensional reference system, and in accordance with programming contained in the pre-programmed function 148, the width transition may be initiated when the paving machine 10 reaches a pre-determined point along its path of travel.

In another embodiment the pre-programmed function 148 may be entered into the controller by instructions of the human operator entered through the input output device 144 immediately prior to execution of the pre-programmed function.

Figure 6:
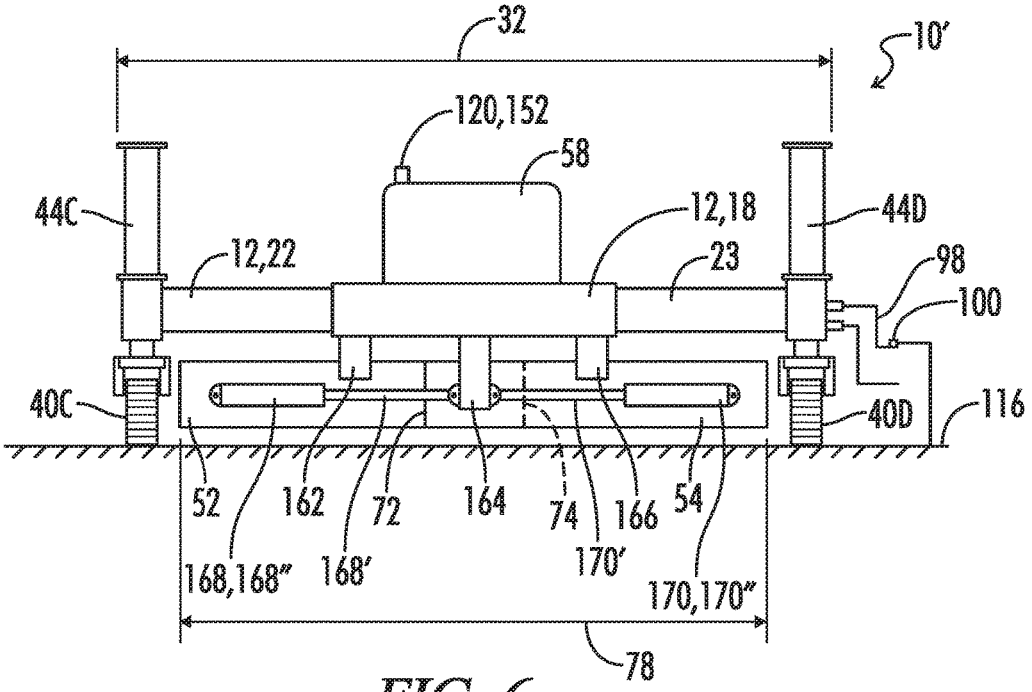
FIG. 6 is a rear elevation view of an alternative embodiment of a paving machine and mold in which the frame width and mold width are independently adjustable.
Figure 7:
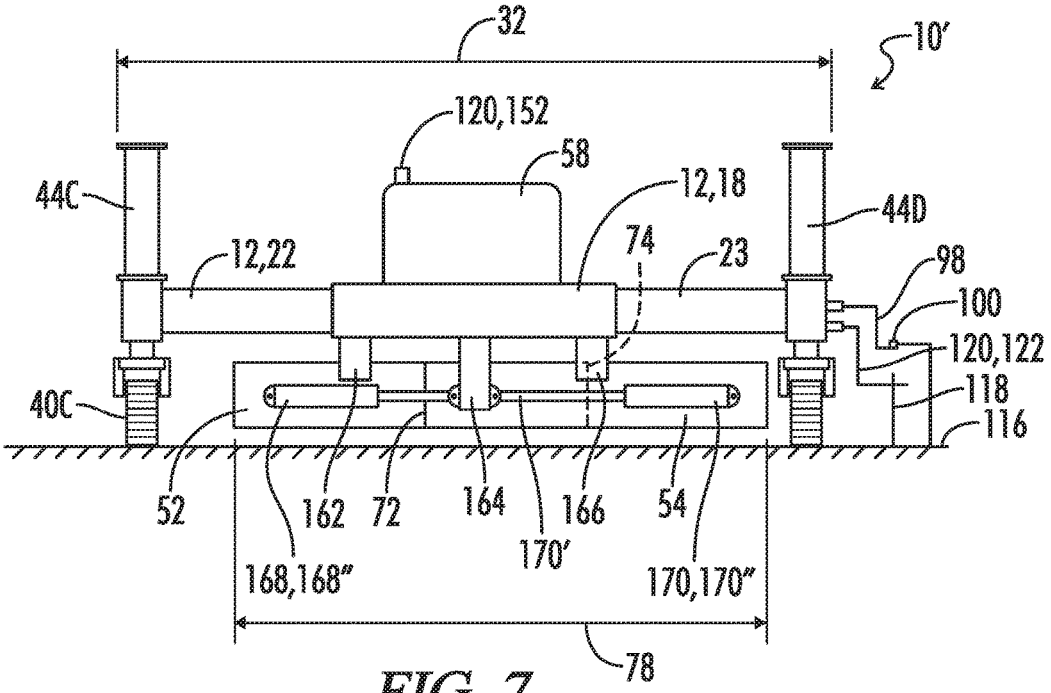
FIG. 7 is a view similar to FIG. 6, showing the mold contracted to a smaller mold width while the machine frame width has not changed from the view of FIG. 6.

The Embodiment of FIGS. 6-7

Referring now to FIGS. 6 and 7, an alternative embodiment of the paving machine 10 is shown and generally designated by the numeral 10'. Many features of the paving machine 10' are identical or analogous to features previously described for the paving machine 10 and that description will not be repeated. Like numerals are used to identify those similar or identical components.

The paving machine 10' has its two mold components 52 and 54 mounted and constructed so that the mold width 78 is variable independently of the frame width 32 over at least a portion of a variable mold width range for the mold width 78.

The paving machine 10' includes first, second and third downward extending support members 162, 164 and 166 fixed to the main frame module 18 of machine frame 12. The first and second mold portions 52 and 54 are slidably supported on the support members 162, 164 and 166 so that each of the mold members 52 and 54 may slide horizontally left and right. Each of the mold members 52 and 54 has associated therewith a mold width actuator 168 and 170, respectively. Each mold width actuator has a piston portion 168' and 170', and a cylinder portion 168" and 170", respectively. Each of the pistons portions 168' and 170' have an end thereof fixed to the center support 164. Each of the cylinder portions 168" and 170" has an end pivotally connected to its respective mold portion 52 and 54. Thus, either or both of the mold parts 52 and 54 may slide inward to reduce the mold width 78. For example as shown in FIG. 7, the mold width actuator 168 for mold part 52 has partially retracted its piston 168' within its cylinder 168" to slide the mold part 52 from left to right as seen in FIGS. 6 and 7 thus reducing the mold width 78 while the frame width 32 has stayed constant.

As seen in FIG. 8, the controller 126 may control the extension of the mold width actuators 168 and 170 via control signals sent over a communications line 131. Each of the hydraulic rams 168 and 170 may be actuated by a hydraulic control valve which controls the flow of hydraulic fluid to and from the opposite sides of the hydraulic ram. The hydraulic control valves may be controlled by electrical signals conducted over the communication line 131 from controller 126 in a known manner.

It is also possible to provide a further embodiment of the paving machine in which one of the mold parts such as mold part 54 is supported to move with the machine frame 12 as shown in FIG. 3, and the other mold part such as mold part 52 is constructed to be movable independently of the machine frame as shown in FIG. 6.

In either event, the mold is describable as being variable in mold width independently of the frame width 32 over at least a portion of the variable mold width range.

In each of the disclosed embodiments the mold width 78 is variable in a generally continuous manner over at least a portion of a variable mold width range. Although not illustrated herein it is noted that the embodiments disclosed herein may be used in conjunction with various bolt-in frame extensions which modify the overall frame width and/or mold width, but at least a portion of the mold width variation is automatically controllable on the fly while the paving machine is moving in the operating direction.

Methods of Operation

Utilizing the systems described above, a method of operating a slipform paving machine 10 is provided which permits the slipform paving machine 10 to move forward in the operating direction 34 and to mold the concrete 60 into a concrete slab structure 62 extending between the ground engaging units 40 and behind the concrete mold 52, 54. The width of the concrete slab structure 62 may be varied on the fly as the paving machine moves forward.

A method of operating the slipform paving machine 10 may include steps of:

(a) Providing a slipform paving machine including a machine frame having a variable frame width 32 between the first and second sides of the machine. The paving machine includes the plurality of ground engaging units 40, with at least one of the ground engaging units 40 being steerable to control the direction of the slipform paving machine 10. The machine further includes the plurality of height adjustable supports 44 supporting the machine frame 12 from the ground engaging units 40. A mold 52, 54 is supported from the machine frame 12, and is variable in mold width 78. Width actuators 24, 26, 28 and 30 and/or 168 and 170 are configured to vary the mold width 78;

(b) Moving the slipform paving machine 10 forward in the operating direction 34 and molding concrete 60 into the concrete slab structure 62 extending between the ground engaging units 40 and behind the mold 52, 54, with the concrete slab structure 62 having an upper surface 64 and sides 66L and 66R;

(c) During step (b) detecting the external stringline reference 100 with a stringline sensor 98 and generating a guidance signal for the direction and height of the right hand side 16 of the paving machine 10;

(d) Controlling the direction and height of the right hand side of the machine frame 12 with the automatic control system 124 in response to the guidance signal from the stringline sensor 98;

(e) During step (b) generating the cross slope signal with the cross slope sensor 110;

(f) Controlling the height of the left hand side 14 of the machine frame 12 with the automatic control system 124 in response to the cross slope signal;

(g) Generating the starting signal via the starting signal generator 120 for a change in the paving width Y; and (h) In response to the starting signal, controlling extension of the width actuators with the automatic control system 124 to change the mold width 78 and thereby change the paving width Y in response to the starting signal as the slipform paving machine 10 moves forward in the operating direction 34.

In a preferred embodiment the automatic control system 124 may control extension of the width actuators in accordance with the pre-programmed function 148.

In a further preferred embodiment the travel distance signal is generated by the travel distance sensor 150 and is representative of the distance traveled in the X direction by the slipform paving machine 10 beyond an initial location such as $X_1$ at the time of receipt of the starting signal, and in step (h) the automatic control system 124 controls the extension of the width actuators in accordance with the pre-programmed function 148 as a function of the travel distance X.

In one embodiment the pre-programmed function 148 is of the form Y=tan h(X).

In another embodiment the pre-programmed function 148 is of the form that Y is a linear function of X.

In one embodiment in step (a) the machine frame 12 and the mold 52, 54 are connected such that the mold width 78 varies when the frame width 32 varies, and in this embodiment in step (h) the automatic control system 124 changes the frame width 32 and the mold width 78 simultaneously to change the paving width Y.

In another embodiment, in step (a) the machine frame 12 and the mold 52, 54 are configured such that the mold 52, 54 is variable in mold width independently of the frame width 32 over at least a portion of a variable mold width range, and in this embodiment in step (h) the automatic control system 124 changes the mold width 78 at least partly without changing the frame width 32.

In another embodiment in step (g) the starting signal is generated with the starting point sensor 122 detecting the presence of the starting point indicating structure 118.

The starting point sensor 122 contacts the starting point indicating structure 118 in one embodiment. In another embodiment the starting point sensor 122 detects the presence of the starting point indicating structure 118 without contacting the starting point indicating structure 118.

In another embodiment the starting signal may be generated manually by the human operator engaging the start input button or switch 152.

In another embodiment an external starting signal may be received from remote source 156.

In still another embodiment, in step (g) the starting signal may be generated by detecting a position in a three dimensional reference system of the stringless reference object 158 mounted on the slipform paving machine 10.

When extending or contracting the width actuators to vary the frame width and/or the mold width, the ground engaging units on the side of the frame that is moving inward or outward may be steered in order to aid or at least not substantially resist the lateral movement of their associated frame member. Such steering of the tracks to facilitate the frame extension and contraction may be in accordance with the teachings of U.S. Pat. No. 9,388,537 to Dahm et al., and assigned to the assignee of the present invention, the disclosure of which is incorporated herein by reference.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A slipform paving machine apparatus, comprising:

a machine frame having a variable frame width between a first side and a second side of the machine frame;

a plurality of ground engaging units, at least one of the ground engaging units being steerable to control a direction of the slipform paving machine apparatus;

a plurality of height adjustable supports supporting the machine frame from the plurality of ground engaging units;

a mold supported from the machine frame, the mold being configured to mold concrete into a concrete structure having an upper surface and lateral concrete sides as the slipform paving machine apparatus moves forward in an operating direction, the mold being variable in mold width so as to vary a paving width of the concrete structure;

at least one stringline sensor configured to detect an external stringline reference and to generate a guidance signal for the direction and height of the first side of the machine frame;

a width actuator configured to extend and contract to vary an extension distance of the width actuator and thereby vary the mold width;

an extension sensor configured to generate an extension signal corresponding to the extension distance of the width actuator;

a starting signal generator configured to generate a starting signal for a change in paving width, the starting signal generator including a starting point sensor configured to engage a starting point indicating structure fixed relative to the external stringline reference;

a cross slope sensor configured to generate a cross slope signal corresponding to a cross slope of the machine frame; and a controller configured:

to receive the guidance signal and to control the direction and height of the first side of the machine frame in response to the guidance signal;

to receive the cross slope signal and to control the cross slope of the machine frame and thereby control a height of the second side of the machine frame in response to the cross slope signal;

to receive the starting signal and the extension signal and to control extension of the width actuator in accordance with a preprogrammed function to change the paving width in response to the starting signal as the slipform paving machine apparatus moves forward in the operating direction after receiving the starting signal.

2. The apparatus of claim 1, further comprising:

a travel distance sensor configured to generate a travel distance signal representative of a distance traveled by the slipform paving machine apparatus in the operating direction beyond an initial location of the slipform paving machine apparatus at a time of receipt of the starting signal; and wherein the controller is further configured to control the extension of the width actuator in accordance with the preprogrammed function as a function of the travel distance.

3. The apparatus of claim 2, wherein:

the travel distance sensor includes a rotary pickup sensor associated with at least one of the ground engaging units.

4. The apparatus of claim 2, wherein:

the preprogrammed function is of the form Y=tan h(X), where Y is the paving width and X is the travel distance.

5. The apparatus of claim 2, wherein:

the preprogrammed function is of the form that Y is a linear function of X, where Y is the paving width and X is the travel distance.

6. The apparatus of claim 1, wherein:

the machine frame and the mold are connected such that the mold width varies when the frame width varies, and the width actuator is arranged to vary the frame width and thereby vary the mold width and the paving width.

7. The apparatus of claim 1, wherein:

the mold is variable in mold width independently of the frame width over at least a portion of a variable mold width range.

8. The apparatus of claim 1, wherein:

the starting signal generator includes a manual start input configured such that a human operator of the paving machine apparatus can initiate the starting signal by manual operation of the manual start input.

9. The apparatus of claim 1, wherein:

the starting signal generator includes a starting signal receiver configured to receive an external starting signal from a remote source.

10. The apparatus of claim 1, wherein:

the starting signal generator includes a stringless reference object configured to detect the position of the stringless reference object in a three-dimensional reference system.

11. The apparatus of claim 1, wherein:

the width actuator includes a piston and cylinder arrangement; and the extension sensor is integrated in the piston and cylinder arrangement.

12. A method of operating a slipform paving machine, the method comprising:

(a) providing a slipform paving machine including:

a machine frame having a variable frame width between a first side and a second side of the machine frame;

a plurality of ground engaging units, at least one of the ground engaging units being steerable to control a direction of the slipform paving machine;

a plurality of height adjustable supports supporting the machine frame from the plurality of ground engaging units;

a mold supported from the machine frame, the mold being variable in mold width; and a width actuator configured to vary the mold width;

(b) moving the slipform paving machine forward in an operating direction and molding concrete into a concrete slab structure extending between the ground engaging units and behind the mold, the structure having an upper surface and lateral concrete sides and having a paving width;

(c) during step (b) detecting an external stringline reference with a stringline sensor of the slipform paving machine and generating a guidance signal for the direction and height of the first side of the machine frame;

(d) controlling the direction and height of the first side of the machine frame with an automatic control system in response to the guidance signal from the stringline sensor;

(e) during step (b) generating a cross slope signal with a cross slope sensor, the cross slope signal corresponding to a cross slope of the machine frame;

(f) controlling the height of the second side of the machine frame with the automatic control system in response to the cross slope signal;

(g) generating a starting signal for a change in paving width by engaging a starting point sensor with a starting point indicating structure fixed relative to the external stringline reference; and (h) in response to the starting signal, controlling extension of the width actuator with the automatic control system in accordance with a preprogrammed function to change the mold width and thereby change the paving width in response to the starting signal as the slipform paving machine moves forward in the operating direction.

13. The method of claim 12, further comprising:

generating a travel distance signal representative of a distance traveled by the slipform paving machine in the operating direction beyond an initial location of the slipform paving machine at a time of receipt of the starting signal; and wherein in step (h) the automatic control system controls the extension of the width actuator in accordance with the preprogrammed function as a function of the travel distance.

14. The method of claim 13, wherein:

the preprogrammed function is of the form $Y=\tan h(X)$, where Y is the paving width and X is the travel distance.

15. The method of claim 13, wherein:

the preprogrammed function is of the form that Y is a linear function of X, where Y is the paving width and X is the travel distance.

16. The method of claim 12, wherein:

in step (a) the machine frame and the mold are connected such that the mold width varies when the frame width varies; and in step (h) the automatic control system changes the frame width and the mold width simultaneously to change the paving width.

17. The method of claim 12, wherein:

in step (a) the machine frame and the mold are configured such that the mold is variable in mold width independently of the frame width over at least a portion of a variable mold width range; and in step (h) the automatic control system changes the mold width at least partly without changing the frame width.

* * * * *